US006953013B2

(12) United States Patent
Tani

(10) Patent No.: US 6,953,013 B2
(45) Date of Patent: Oct. 11, 2005

(54) VALVE TIMING CONTROLLER

(75) Inventor: Hideji Tani, Hashima-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/961,083

(22) Filed: Oct. 12, 2004

(65) Prior Publication Data

US 2005/0081809 A1 Apr. 21, 2005

(30) Foreign Application Priority Data

Oct. 16, 2003 (JP) ..... 2003-356188
Aug. 4, 2004 (JP) ..... 2004-228127

(51) Int. Cl.[7] ..... F01L 1/34
(52) U.S. Cl. ..... 123/90.17; 123/90.15; 123/90.31
(58) Field of Search ..... 123/90.15, 90.17, 123/90.31

(56) References Cited

U.S. PATENT DOCUMENTS 4,873,453 A * 10/1989 Schmerda et al. ..... 307/130
6,138,622 A * 10/2000 Heer ..... 123/90.17
6,843,344 B2 * 1/2005 Kodama et al. ..... 180/446

FOREIGN PATENT DOCUMENTS

JP U-4-105906 9/1992
JP A-8-317679 11/1996

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

A valve timing controller is driven by a motor and has a control circuit and a driving circuit. The driving circuit drives the motor according to a target rotation speed which is represented by a control signal frequency generated by the control circuit. Accordingly as the frequency becomes higher, the target rotation speed increases. When the frequency of the control signal is either lower than or equal to a first threshold frequency, or higher than or equal to a second threshold, the first threshold frequency being greater than zero and being greater than the second threshold frequency, the driving circuit stops supplying current to the motor.

16 Claims, 10 Drawing Sheets

FIG. 8A
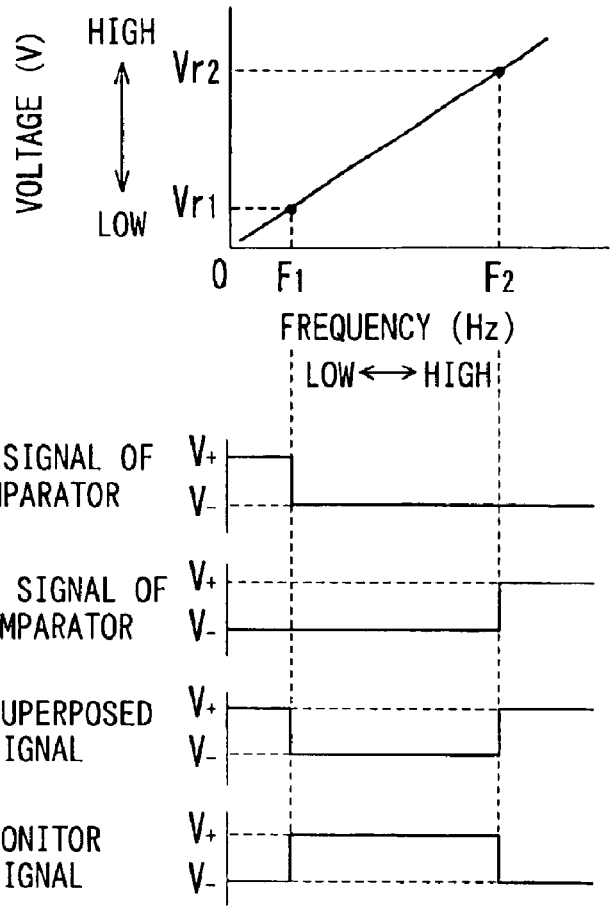
FIG. 8B
FIG. 8C
FIG. 8D
FIG. 8E
FIG. 9
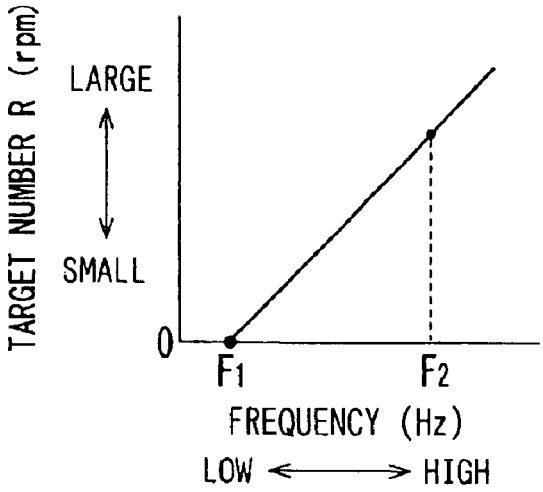

1st CONTROL SIGNAL
DUTY: $r_1 = t_H/T*100$

HALL EFFECT DEVICE
DUTY: $r_2 = t_H/T*100$

CURRENT
DUTY: $r_3 = t_H/T*100$

OVER-CURRENT
DUTY: $r_4 = t_H/T*100$

NORMAL
DUTY: $r_5 = t_H/T*100$

VALVE TIMING CONTROLLER

CROSS REFERENCE TO RELATED APPLICATION

This application is based on Japanese Patent Applications No. 2003-356188 filed on Oct. 16, 2003 and No. 2004-228127 filed on Aug. 4, 2004, the disclosures of which are incorporated herein by reference.

FIELD OF THE INVENTION

The present invention relates to a valve timing controller which is driven by an electric motor. The valve timing controller changes valve timing of an intake valve and/or an exhaust valve of the internal combustion engine. The valve timing controller (VTC) driven by the motor is referred to as the motor drive VTC hereinafter.

BACKGROUND OF THE INVENTION

In a motor drive VTC shown in JP-U-4-105906A, a control circuit generates a control signal which the driving circuit receives. The driving circuit supplies a current to the motor according to the control signal. The control signal represents a target rotation speed of the motor, which is referred to as the target number hereinafter. The driving circuit applies the current to the motor in such a manner that an actual rotation speed of the motor becomes the target number.

The control signal has a frequency which is proportional to the target number in order to transmit the control signal to the driving circuit correctly.

If the signal line is broken and the control signal is not transmitted from the control circuit to the driving circuit, the driving circuit effectively receives a zero frequency signal. The driving circuit therefore supplies current to the motor as if the frequency of the control signal is zero. In such a case, as the rotation speed of the motor is higher before the signal line break, a rapid change of the rotation speed of the motor occurs so that a rotational-phase changing mechanism may be damaged.

When high frequency noise is superposed on the control signal, the frequency of the control signal may represent a higher rotation speed than the target number. The motor in such a case rotates at a higher rotation speed than the target number so that the rotational-phase changing mechanism and/or the motor may be damaged.

SUMMARY OF THE INVENTION

An object of the present invention is to provide a valve timing controller which reduces damage and/or breakage of the rotational-phase changing mechanism and/or the motor. According to an exemplary embodiment of the present invention, a valve timing controller for adjusting valve timing of an engine utilizes rotational torque of a motor, and includes a control circuit generating a control signal and a driving circuit for driving the motor based on a target rotation speed which is represented by the control signal frequency. The higher frequency of the control signal represents a higher target rotation speed, and the driving circuit stops supplying current to the motor when the frequency of the control signal is a threshold frequency or lower, which is higher than zero.

BRIEF DESCRIPTION OF THE DRAWINGS

Other objects, features and advantages of the present invention will become more apparent from the following detailed description made with reference to the accompanying drawings, in which like parts are designated by like reference numbers and in which:

FIGS. 8A to 8E are characteristic diagrams for explaining the driving circuit shown in FIG. 1;

FIG. 9 is a characteristic diagram for explaining the first control signal generated by a modified control circuit of the first embodiment;

DETAILED DESCRIPTION OF EMBODIMENT

An embodiment of the present invention will be described hereinafter with reference to the drawings.

(First Embodiment)

Figure 1:
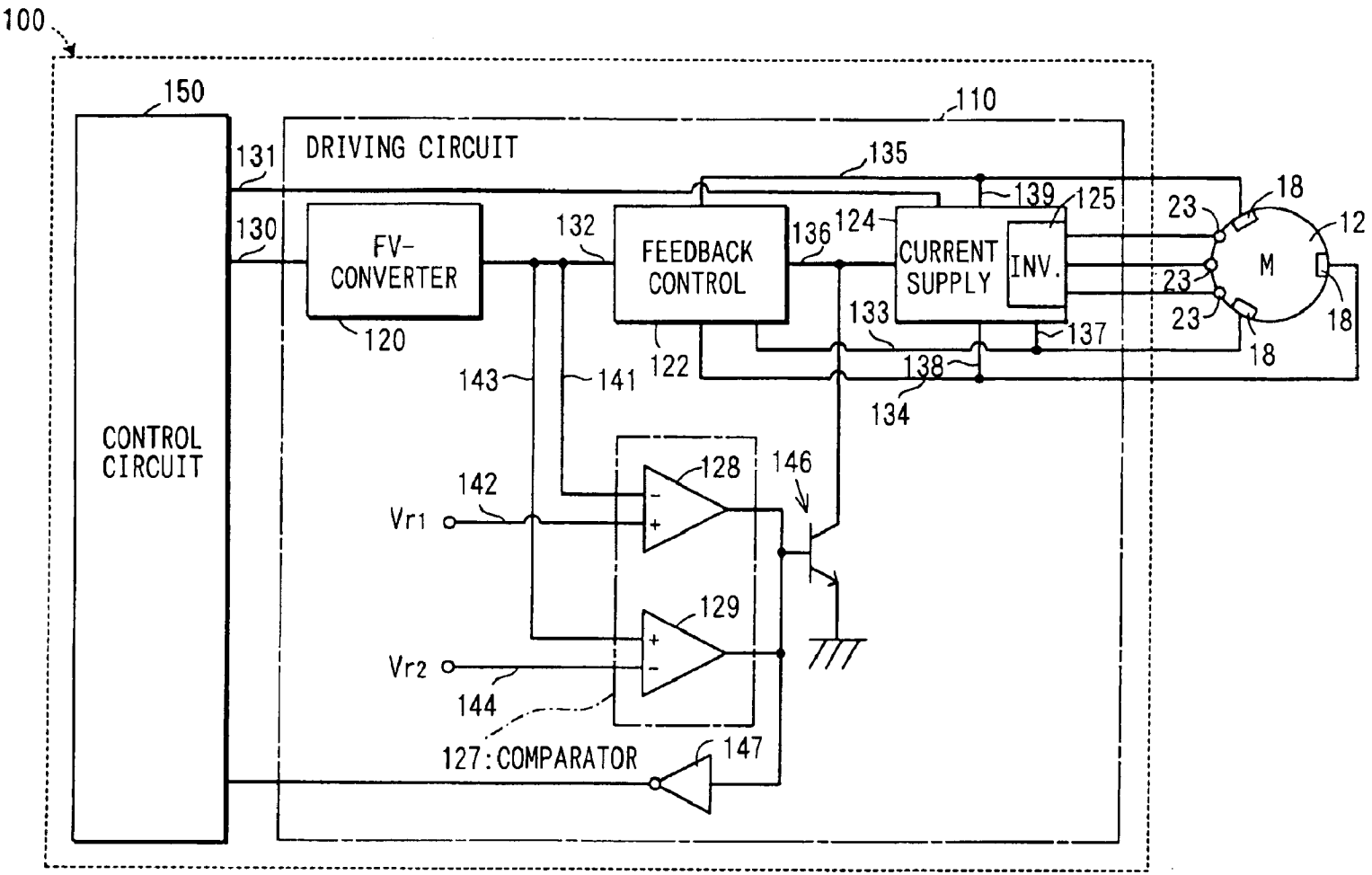
FIG. 1 is a block diagram showing a motor control device according to a first embodiment of the present invention.
Figure 2:
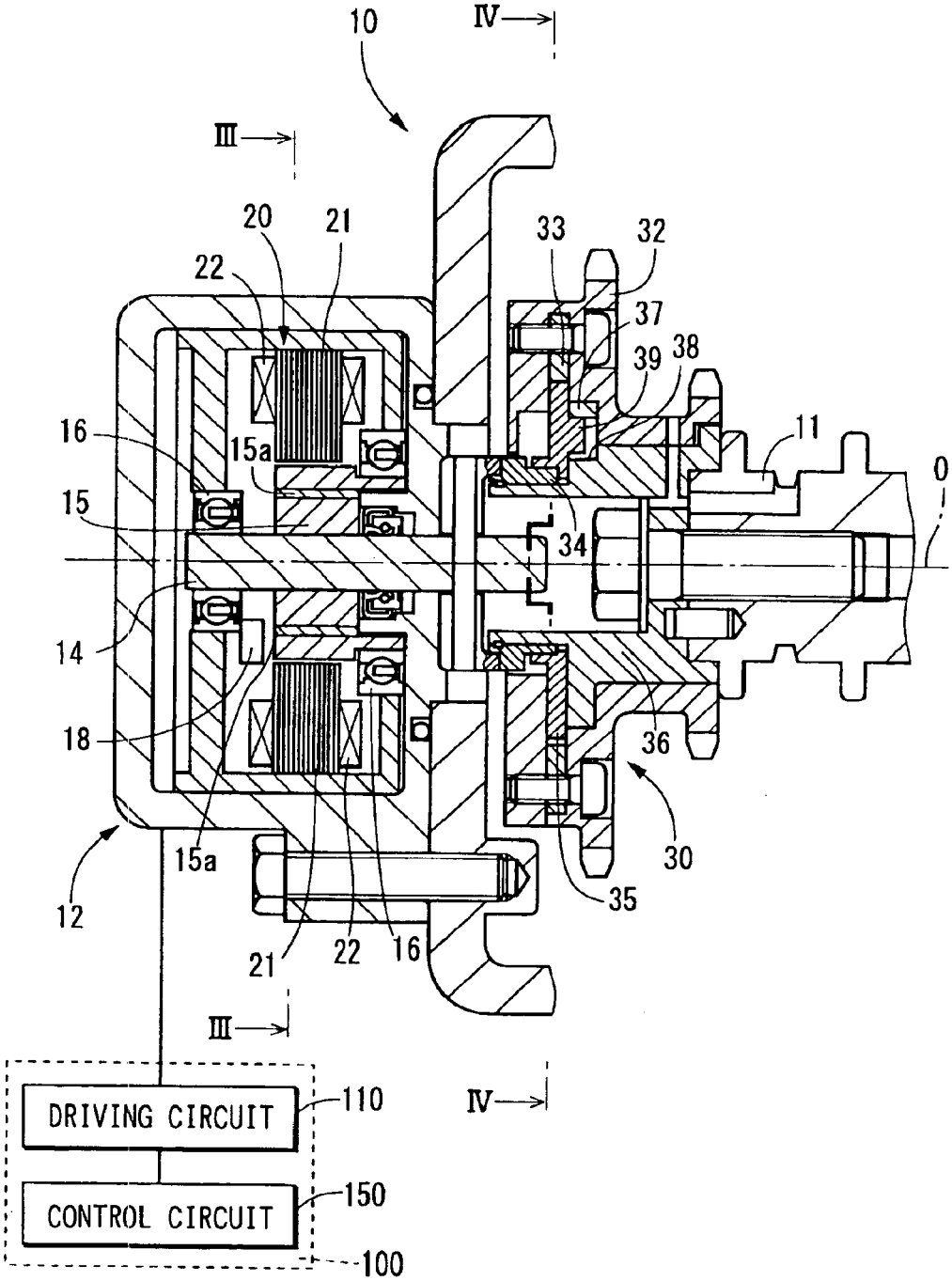
FIG. 2 is a cross-sectional view of the valve timing controller according to the first embodiment.
Figure 3:
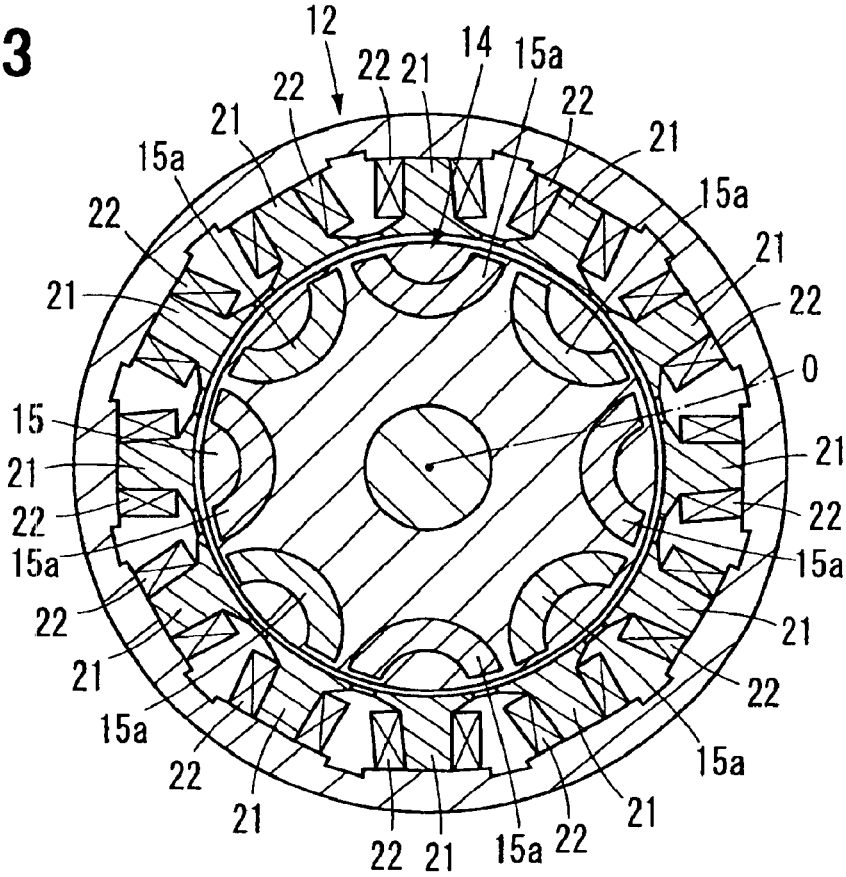
FIG. 3 is a cross-sectional view along the signal line III—III in FIG. 2.
Figure 4:
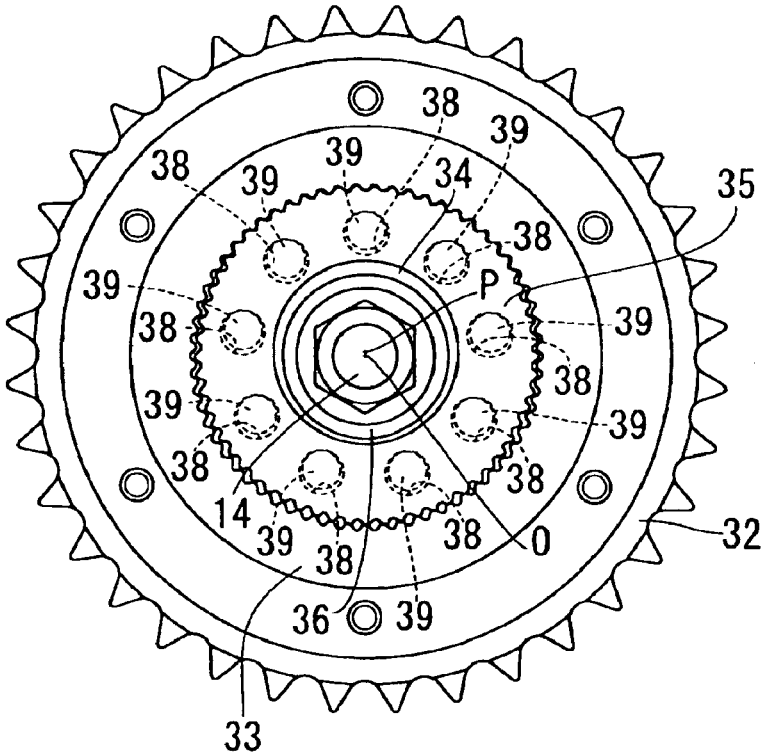
FIG. 4 is a cross-sectional view along the signal line IV—IV in FIG. 2.

Referring to FIGS. 2 to 4, a first embodiment is described hereinafter. The motor drive VTC 10 is disposed in a torque transfer system from a crankshaft to a camshaft 11. The motor drive changes valve timing of the intake valve and the exhaust valve by utilizing a rotational torque of an electric motor 12 which is controlled by a motor control device 100.

The electric motor 12 is a three-phase brushless motor having a motor shaft 14, a bearing 16, Hall effect devices 18, and a stator 20.

The motor shaft 14 is supported by a pair of bearings 16 and rotates clockwise/counterclockwise around an axis "O". In FIG. 3, when the motor shaft 14 rotates clockwise, it is called that the motor shaft 14 rotates in normal direction. When the motor shaft 14 rotates counterclockwise, it is called that the motor shaft 14 rotates in reverse direction. A rotor 15 is provided on the motor shaft 14 and has eight magnets 15*a* therein. Each of the magnets 15*a* is disposed around the axis "O" at regular intervals, and has a different magnetic pole between adjacent magnets 15*a*, which is generated on the outer surface of the rotor 15. The three Hall effect devices 18 are disposed around the axis "O" at regular intervals in the vicinity of the rotor 15, and generate a high voltage signal and a low voltage signal according to the position of the magnets 15*a*.

Figure 5:
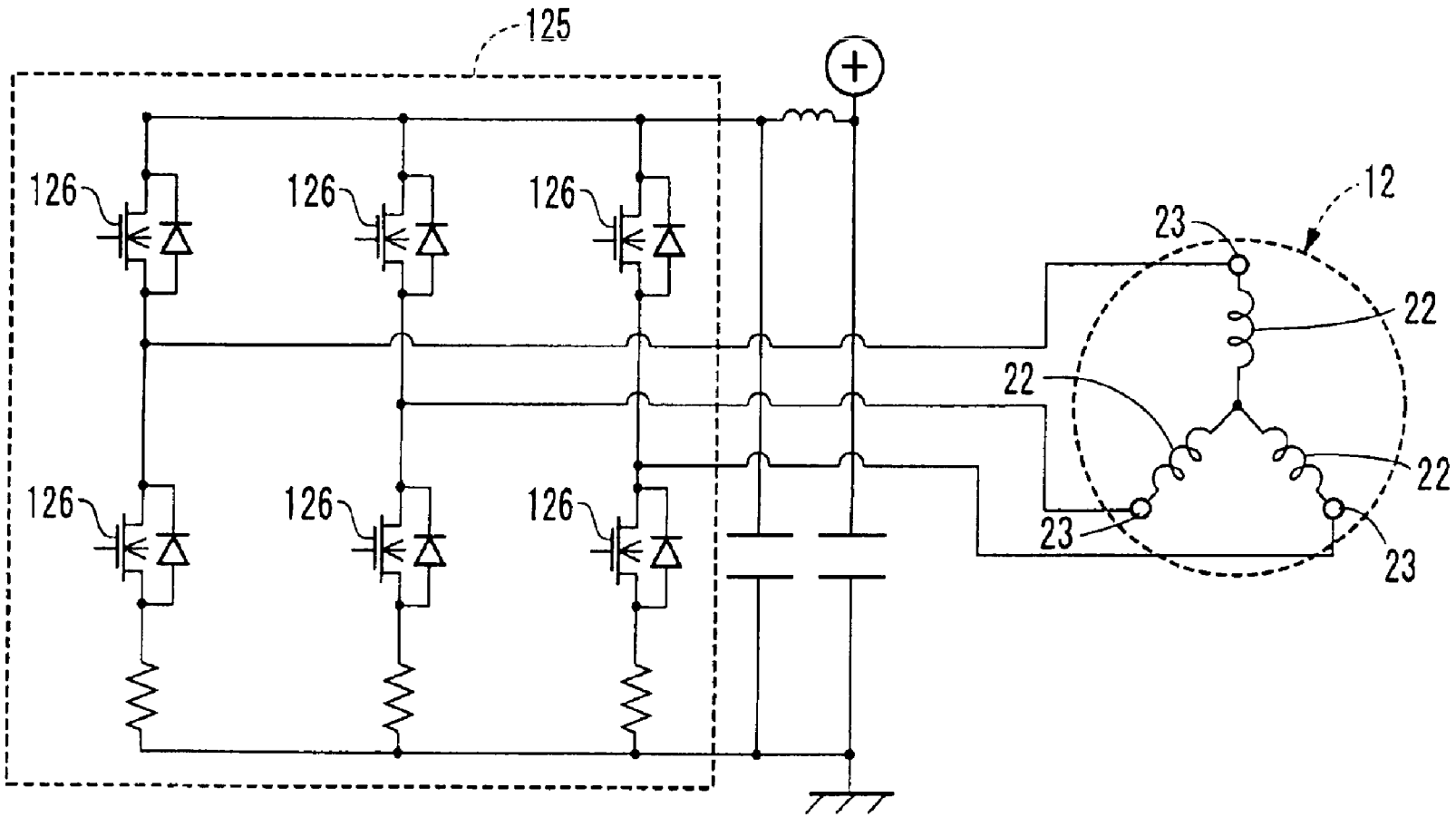
FIG. 5 is a schematic circuit diagram of an essential part of the driving circuit shown in FIG. 1.

The stator 20 is disposed around the motor shaft 14. The stator 20 has twelve cores 21 which are disposed at regular intervals around the axis "O" and on each of which a coil 22 is wound. The coils 22 are connected in the star connection at one end as shown in FIG. 5 and are connected to a drive circuit 110 of the motor control device 100 at the other end 23. The energized coil 22 generates a rotational magnetic field around the motor shaft 14 clockwise or counterclockwise. When the clockwise magnetic field is generated in FIG. 3, the magnets 15*a* receive the interaction so that the rotational torque in the normal direction is applied to the motor shaft 14. Similarly, when the counterclockwise magnetic field is generated, the rotational torque in the reverse direction is applied to the motor shaft 14.

A phase changing mechanism 30 of VTC 10, as shown in FIGS. 2 and 4, has a sprocket 32, a ring gear 33, an eccentric shaft 34, a planetary gear 35, and an output shaft 36.

The sprocket 32 is provided on the same axis of the output shaft 36, and rotates around the axis "O" in the same direction as the motor shaft 14. The sprocket 32 rotates around clockwise in FIG. 4 while maintaining the rotational phase relative to the crankshaft. The ring gear 33 is an internal gear, and is coaxially fixed on the inside of the sprocket 32 to rotate together.

The eccentric shaft 34 is directly connected to the motor shaft 14 to rotate together. The planetary gear 35 is an external gear, and is disposed in the inside of the ring gear 33 while engaging the teeth thereof with the teeth of the ring gear 33. The planetary gear 35 is coaxially supported by the eccentric shaft 34 and rotates around an eccentric axis "P". The output shaft 36 is coaxially connected to the camshaft 11 by a bolt to rotate around the axis "O" with the camshaft 11. The output shaft 36 has an engaging plate 37 which is a disk-shaped plate having the center axis "O". The engaging plate 37 has nine engaging holes 38 which are formed at regular intervals around the axis "O". The planetary gear 35 has nine engaging projections 39 around the eccentric axis "P" which are engaged with the engaging holes 38 individually.

When the motor shaft 14 does not rotate relative to the sprocket 32, the planetary gear 35 rotates clockwise with the sprocket 32 while maintaining the engaging position with the ring gear 33. Because the engaging projections 39 urge the inner surface of the engaging holes 38, the output shaft 36 rotates clockwise without relative rotation to the sprocket 32 by which a rotational phase of the camshaft 11 relative to the crankshaft is maintained. The rotational phase of the camshaft 11 relative to the crankshaft is referred to as the rotational phase.

When the motor shaft 14 rotates counterclockwise relative to the sprocket 32, the planetary gear 35 rotates clockwise relative to the eccentric shaft 34 to change engaging position with the ring gear 33. At this moment, the urging force by which the engaging projections 39 urge the inner surface of the engaging holes 38 increases, so that the rotational phase of the output shaft 36 is advanced relative to the sprocket 32. That is, the rotational phase of the camshaft 11 relative to the crankshaft is advanced.

When the motor shaft 14 rotates clockwise relative to the sprocket 32, the planetary gear 35 rotates counterclockwise relative to the eccentric shaft 34 to change engaging position with the ring gear 33. At this moment, the urging force by which the engaging projections 39 counterclockwise urge the inner surface of the engaging holes 38 increases, so that the rotational phase of the output shaft 36 is retarded relative to the sprocket 32. That is, the rotational phase of the camshaft 11 relative to the crankshaft is retarded.

As shown in FIG. 2, the motor control device 100 has the driving circuit 110 and the control circuit 150. Both of the circuits 110 150 are schematically illustrated at the outside of the motor 12. However, each of the circuits 110, 150 can be disposed at the inside or the outside of the motor 12.

Figure 6:
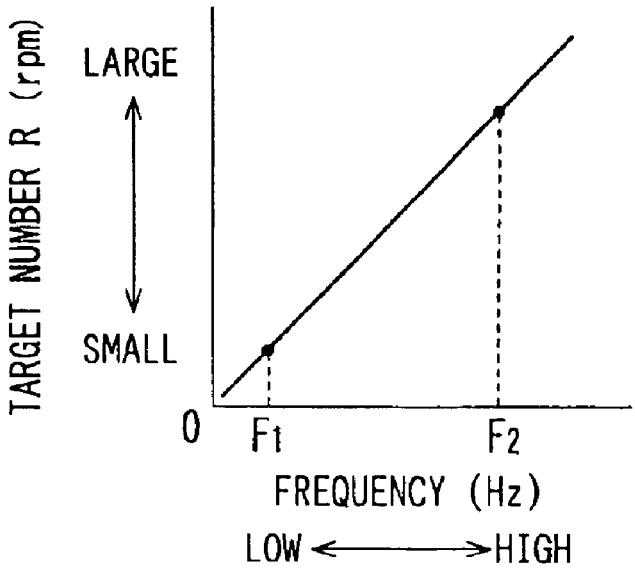
FIG. 6 is a graph showing a relationship between the target number and a frequency of a first control signal.

The control circuit 150 controls the electric current which is supplied from the driving circuit 110 to the motor 12, and also controls an igniter and a fuel injection device of the engine. The control circuit 150 determines a target rotation speed of the motor shaft 14, which is referred to as the target number R, and a target rotational direction of the motor shaft 14, which is referred to as the target direction D. The target number R is an absolute number which does not represent the rotational direction of the motor shaft 14. The control circuit is connected with sensors which detect rotation speeds of the crankshaft and the camshaft 11, and determines the target number R and the target direction D based on the detected signal by the sensors. The target number R is represented by a first control signal and the target direction D is represented by a second signal. The frequency of the first control signal is in proportional to the target number R as shown in FIG. 6. That is, the target number R is represented by the frequency of the first control signal. The target direction D is represented by a voltage of the second control signal.

The driving circuit supplying the current to the motor 12 includes a FV converter 120, a feedback control section 122, a current supply section 124, and a comparator 127.

Figure 7:
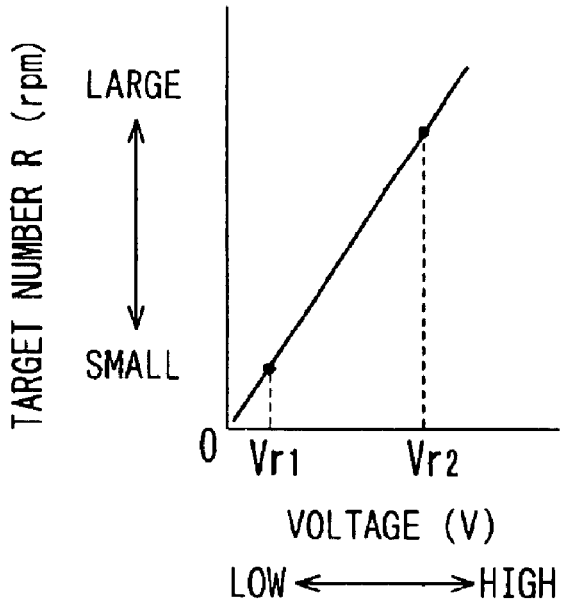
FIG. 7 is a graph showing a relationship between the target number and a voltage of the first control signal.

The FV converter 120 is connected with the control circuit 150 via a signal line 130 through which the first control signal is transmitted from the control circuit 150 to the FV converter 120. The FV converter 120 converts the frequency of the first control signal into the voltage. The voltage is in proportion to the target number R as shown in FIG. 7. Therefore, the frequency of the first control signal is in proportion to the converted voltage as shown in FIG. 8A.

The feedback control section 132 receives the first control signal, which is converted by the FV converter 120, from the FV converter 120 through a signal line 132. The feedback control section 122 receives signals from each of the Hall effect devices 18 through signal lines 133, 134, 135 in order to calculate the actual rotation speed of the motor Rr and to determine the voltage Vs by which the actual rotation speed Rr of the motor is consistent with the target number R. The feedback control section 122 sends a command signal to the current supply section 124 through a signal line 136 in order to generate the voltage Vs in the current supply section 124.

The current supply section 124 receives the second control signal from the control circuit 150 through a signal line 131, the command signal through the signal line 136. When the current supply section 124 receives no command signal from the feedback control section 122, the current supply section 124 stops supplying the current to the motor 12. When the current supply section 124 receives the command signal from the feedback control section 122, the current supply section 124 applies the voltage Vs to the motor 12 with the second control signal being concerned. The current supply section 124 is connected to the signal lines 133, 134, 135 through signal lines 137, 138, 139. The current supply section 124 includes an inverter circuit 125 which is comprised of a bridge circuit and is connected with the terminals 23 of the wires 22. The current supply section 124 determines the switching order of the switching elements 126, and applies the voltage Vs to the wire 22 between two of the switching elements 126 which are turned on.

The comparator 127 includes a first comparator 128 and a second comparator 129.

An inverting input terminal of the first comparator 128 is connected with the signal line 132 through a signal line 141 to receive the first control signal converted by the FV converter 120. A non-inverting input terminal of the first comparator 128 is connected with the signal line 142 to receive a first reference voltage $V_{r1}$. The first comparator 128 compares the voltage of the first control signal representing target number R with the first reference voltage $V_{r1}$, and varies the voltage of an output signal. As shown in FIG. 8B, when the voltage of the first control signal is the first reference voltage $V_{r1}$ or lower, the voltage of the output signal is positive voltage $V_+$. When the voltage of the first control signal is higher than the first reference voltage $V_{r1}$, the voltage of the output signal is negative voltage $V_-$. The first reference voltage $V_{r1}$ corresponds to a first threshold frequency $F_1$ which is larger than zero Hz as shown in FIG. 8A. Thus, when the frequency of the first control signal is the first threshold frequency $F_1$ or lower, the positive voltage $V_+$ is output, and when the frequency of the first control signal is higher than the first threshold frequency $F_1$, the negative voltage $V_-$ is output from the first comparator 128.

Both of the output terminals of the first and the second comparator 128, 129 are connected with a base of the transistor 146. A collector of the transistor 146 is connected with the signal line 136 and an emitter of the transistor 146 is grounded. When the voltage input to the base of the transistor 146 is the positive voltage, the command signal is not transmitted through the signal line 136. In the present embodiment, the output signal of the first comparator 128 and the output signal of the second comparator 129 are combined to be input into the transistor 146 as shown in FIG. 8D. When one of the first comparator 128 and the second comparator 129 outputs the positive voltage $V_+$, the current supply section 124 hardly receive the command signal. When both of the comparators 128, 129 output the negative voltage $V_-$, the current supply section 124 can receive the command signal.

The output terminals of the first and the second comparator 128, 129 are connected with the control circuit 150 through an inverter gate 147. The combined output signal of the first and the second comparator 128, 129 is inverted by the inverter gate 147 to generate a monitor signal which is shown in FIG. 8E.

The operation of the motor control device 100 is described hereinafter.

When the frequency of the first control signal which the FV converter 120 receives is higher than the first threshold frequency $F_1$ and lower than the second threshold frequency $F_2$, both of the voltage of the output signals become the negative voltage $V_-$. Then, the current supply section 124 receives the command signal from the feedback control section 122 to apply the voltage Vs to the motor 12.

When the frequency of the first control signal which the FV converter 120 receives is the first threshold frequency $F_1$ or lower, the output signal of the second comparator 129 becomes the negative voltage $V_-$ and the output signal of the first comparator 128 becomes the positive voltage $V_+$. The current supply section 124 cannot receive the command signal from the feedback control section 122 and stops supplying the current to the motor 12. The first threshold frequency $F_1$ is set as 40 Hz for holding the valve timing at the engine start.

When the frequency of the first control signal which the FV converter 120 receives is higher than the second threshold frequency $F_2$, the output signal of the first comparator 128 becomes the negative voltage $V_-$ and the output signal of the second comparator 129 becomes the positive voltage $V_+$. The current supply section 124 cannot receive the command signal from the feedback control section 122 and stops supplying the current to the motor 12. The second threshold frequency $F_2$ is lower than the rated frequency of the motor 12, for example, 3200 Hz which is required to vary the rotational phase to the most advanced angle.

The control circuit 150 always receives the monitor signal from the driving circuit 110. That is, according to the voltage of the monitor signal, the control circuit 150 determines whether the motor 12 is driving or not. When the motor 12 is not operated, the control circuit 150 stops to generate the control signal.

According to the first embodiment, when the frequency of the first control signal is the first threshold frequency $F_1$ or lower, the driving circuit 110 stop supplying the current to the motor 12. Therefore, even if the signal line 130 is broken and the first control signal is not transmitted to the driving circuit 110 as if the driving circuit 110 receives the control signal of which frequency is zero Hz, the current supply to the motor is stopped in order to restrict a sudden change of the rotation speed of the motor.

Furthermore, when the frequency of the first control signal is higher than the second threshold frequency $F_2$ which is higher than the first threshold frequency $F_1$, the driving circuit 110 stops supplying current to the motor 12. Even if the frequency of the first control signal represents larger number than the target number R due to the superposing of the high frequency noise on the control signal, the over-rotation of the motor beyond the rated rotation speed and the sudden change of the rotation speed are restrained by stopping the current supply to the motor 12.

FIG. 9 shows a modification of the relationship between the frequency of the first control signal and the target number R. The frequency of the signal is in proportion to the target number R, and when the target number R is zero, the frequency of the signal becomes the first threshold frequency $F_1$. Even when the target number R is slightly larger than zero, the frequency of the first control signal is larger than the first threshold frequency $F_1$ to supply the current to the motor 12, by which the motor can rotates in an actual rotation speed Rr which is close to zero.

(Second Embodiment)

Figure 10:
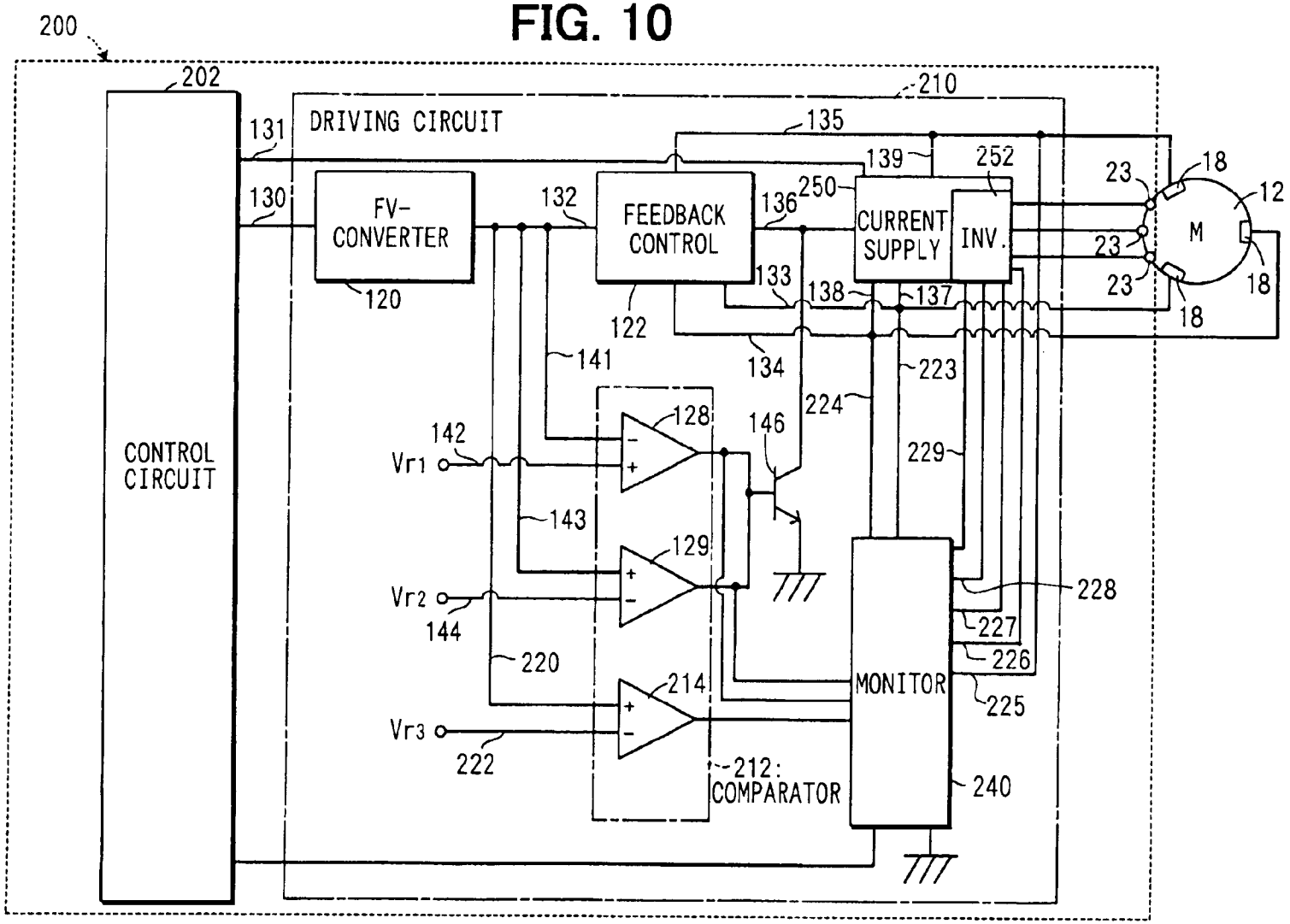
FIG. 10 is a block diagram showing a motor control device according to a second embodiment of the present invention.

FIG. 10 shows a motor control device 200 according to the second embodiment, in which the same parts and components as those in the first embodiment are indicated with the same reference numerals and the same descriptions will not be reiterated.

The control circuit 202 generates a first control signal of which frequency is in proportion to the target number R when the frequency of the signal is over the first threshold frequency $F_1$. The first control signal commands that the current supply to the motor is stopped when the frequency of the first control signal is between the first threshold frequency $F_1$ and a third threshold frequency $F_3$ which is lower than the first threshold frequency $F_1$. A resolution of the frequency difference between the third threshold frequency $F_3$ and zero Hz is higher than a resolution of the first control signal. The target number R corresponding to the first threshold frequency $F_1$ can be zero or larger than zero.

Figure 11A:
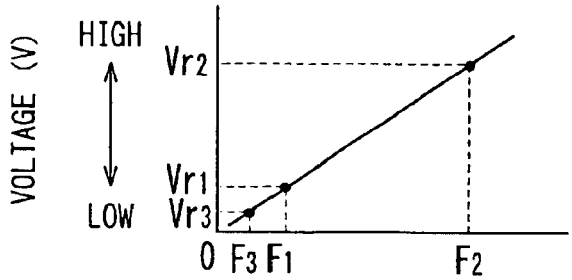
FIGS. 11A to 11E are characteristic diagrams for explaining the driving circuit shown in FIG. 10.
Figure 11B:
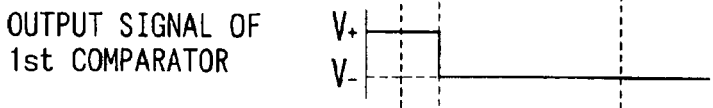
Figure 11C:
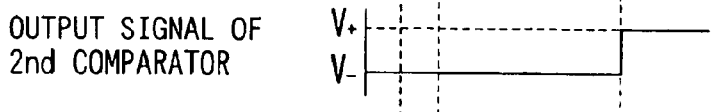
Figure 11D:
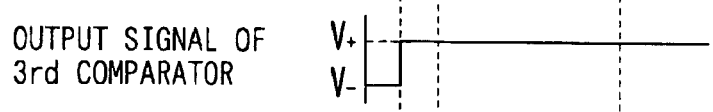

The driving circuit 210 includes the first comparator 128, the second comparator 129, and the third comparator 214. A non-inverting input terminal of the third comparator 214 is connected with a signal line 220 which is divided from the signal line 132, through which the first control signal converted by the FV converter 120 is input to the third comparator 214. An inverting input terminal of the third comparator 214 is connected with a signal line 222 through which a third reference voltage $V_{r3}$ is input to the third comparator 214. The third comparator compares the voltage corresponding to the target number R with the third reference voltage $V_{r3}$. As shown in FIG. 11D, when the voltage of the first control signal is higher than the third reference voltage $V_{r3}$, the voltage of the output signal of the third comparator 214 is positive voltage $V_+$. When the voltage of the first control signal is lower than the third reference voltage $V_{r3}$, the voltage of the output signal is negative voltage $V_-$. The second reference voltage $V_{r3}$ corresponds to a third threshold frequency $F_3$ which is lower than the first threshold frequency $F_1$ and is higher than zero Hz as shown in FIG. 11A. Thus, when the frequency of the first control signal is higher than the third threshold frequency $F_3$, the positive voltage $V_+$ is output, and when the frequency of the first control signal is lower than the third threshold frequency $F_3$, the negative voltage $V_-$ is output from the third comparator 214.

As shown in FIG. 10, the driving circuit 210 includes a monitor section 240 comprised of logic circuits.

Figure 11E:
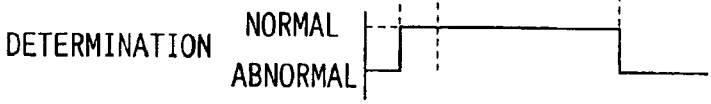

The monitor section 240 is connected with the output terminal of the first to the third comparator 128, 129, 214 for monitoring the output signal thereof to determine whether the first control signal is normal or not. AS shown in FIG. 11E, when the frequency of the first control signal is lower than the third threshold frequency $F_3$ and the output voltage of the first to the third comparator 128, 129, 214 are $V_+$, $V_-$, and $V_-$ respectively, the monitor section 240 determines that an abnormality such as the breakage of the signal line 130 arises in the first control signal. When the frequency of the first control signal is higher than the second threshold frequency $F_2$ and the output voltage of the first to the third comparator 128, 129, 214 are $V_-$, $V_+$, and $V_+$ respectively, the monitor section 240 determines that an abnormality such as a super position of noise on the signal line 130 arises in the first control signal. When the frequency of the first control signal is the third threshold frequency $F_3$ or higher and lower than the second threshold frequency $F_2$ and when the output voltage of the first to the third comparator 128, 129, 214 are $V_+$ or $V_-$, $V_-$, and $V_+$, the monitor section 240 determines the first control signal is normal.

Figure 12:
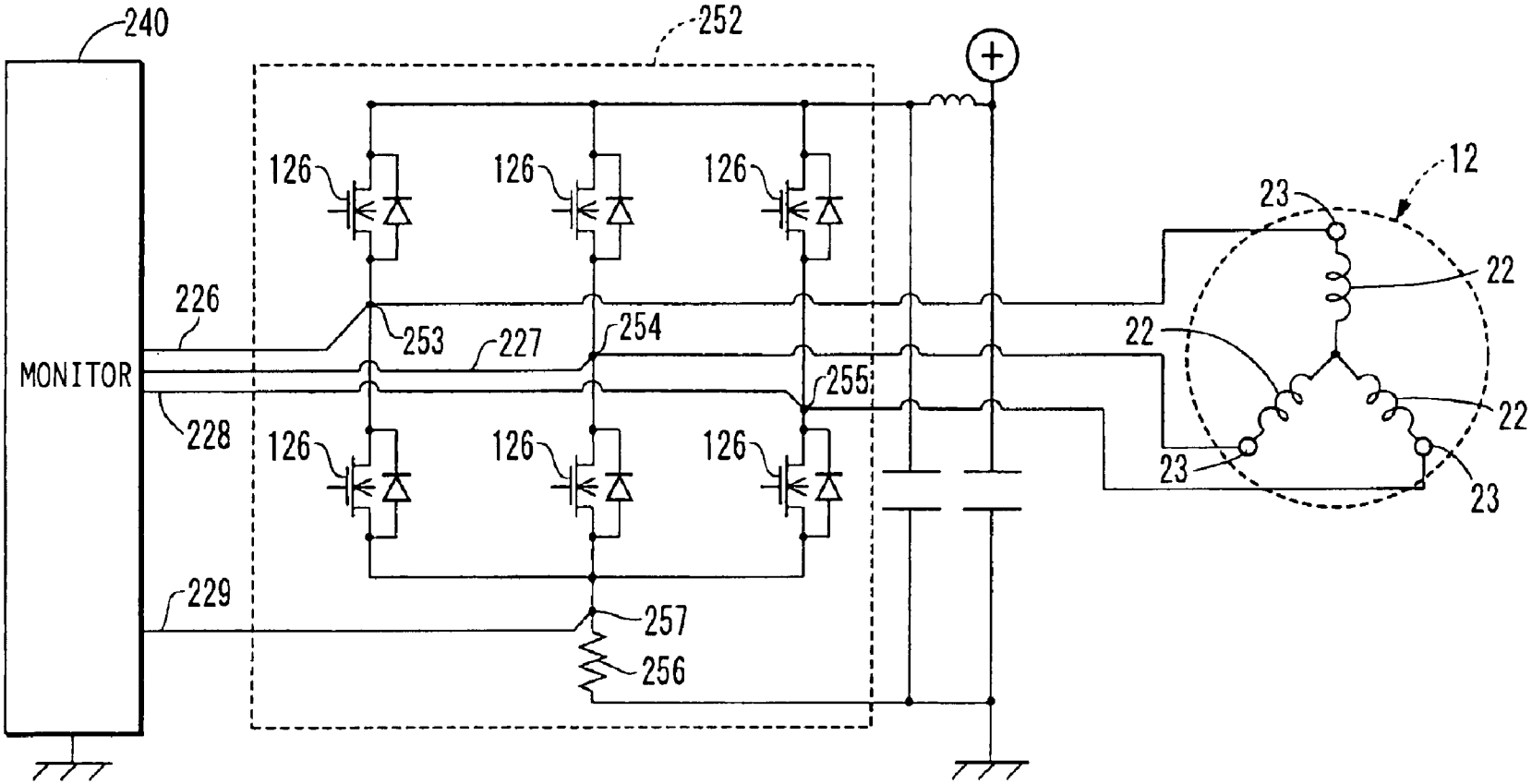
FIG. 12 is a schematic circuit diagram of an essential part of the driving circuit shown in FIG. 10.
Figure 13A:
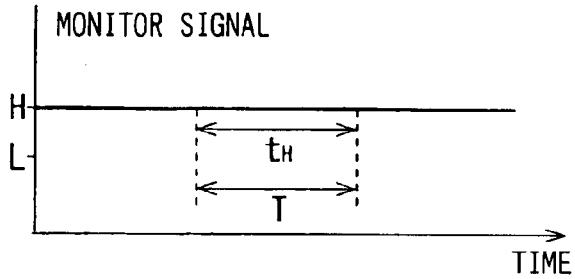
FIGS. 13A to 13E are characteristic diagrams for explaining a monitor signal generated by a monitor section shown in FIG. 10.
Figure 13B:
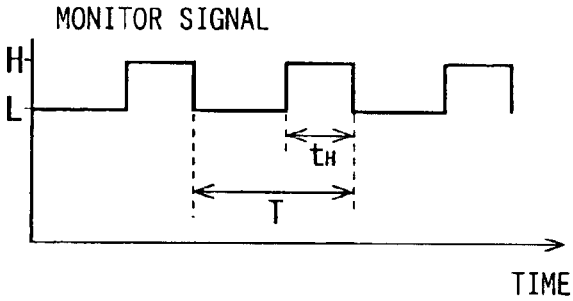
Figure 13C:
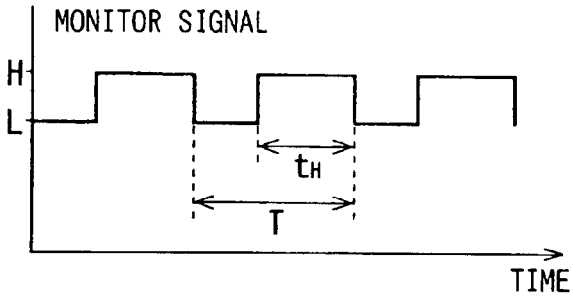
Figure 13D:
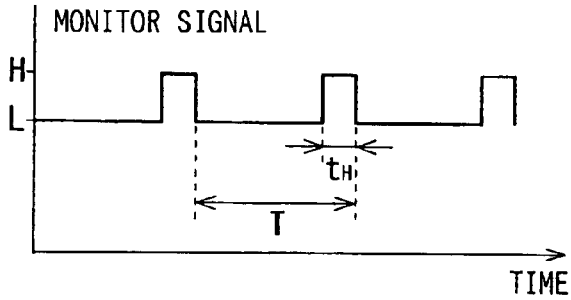
Figure 13E:
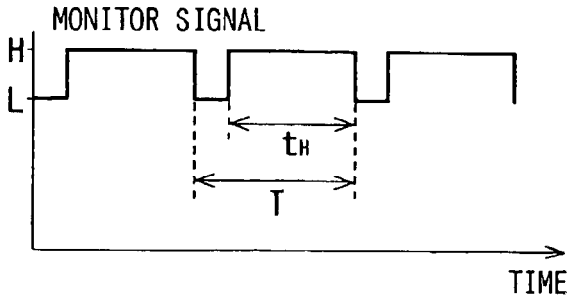

The monitor section 240 is connected with the signal lines 133, 134, 135 through signal lines 223, 234, 225 to monitor the signals detected by the Hall effect devices 18 and to determine the normality of the Hall effect devices 18. As shown in FIG. 12, the monitor section 240 is connected to the connecting positions 253, 254, 255 in the inverter circuit 252 through signal lines 226, 227, 228, whereby the monitor section is connected the wire 23 of the motor 12. Thereby the monitor section 240 monitors the applied voltage Vs to the wire 22 in order to detect the abnormality of the inverter circuit 252 and the motor 12. The monitor section 240 is grounded and is connected with an end 257 of a resistor 256 through a signal line 229. Thereby, the monitor section 240 monitors a current passing through the resistor 256 to determine the abnormality of over-current passing through the inverter circuit 252 and the motor 12.

The monitor section 240 is connected with the control circuit 202 to which the monitor signal is transmitted. As shown in FIG. 13A to 13E, the monitor section 240 generates a monitor signal which represents the abnormality by a duty ratio which is a ratio of time $t_H$ in which the output voltage becomes "H" voltage in one period T. When it is determined an abnormality arises in the first control signal, the duty ratio of the monitor signal is set as a first duty ratio $r_1$, and when it is determined an abnormality arises in at least one of the Hall effect devices 18, the duty ratio of the monitor signal is set as a second duty ratio $r_2$. When the inverter circuit 252 and/or the motor 12 has an abnormality of current supply, the duty ratio of the monitor signal is set as a third duty ratio $r_3$, and when the inverter circuit 252 and/or the motor has an abnormality of over-current supply, the duty ratio of the monitor signal is set as a fourth ratio $r_4$. When the first signal and the Hall effect device 18 have no abnormality, the duty ratio of the monitor signal is set as a fifth ratio $r_5$. With respect to each of the first ratio $r_1$ to the fifth ratio $r_5$, the difference between each of them is higher than the duty ratio of the monitor signal in the control circuit 202. Each of the first ratio $r_1$ to the fifth ratio $r_5$ is respectively set as 100%, 40%, 60%, 20%, and 80%.

According to the second embodiment, the control circuit 202 determines abnormalities arising in the driving circuit 210 based on the duty ratio of the monitor signal to stop generating the control signal.

When the frequency of the first control signal is lower than the third threshold frequency $F_3$, the driving circuit 210 stops to supply the current to the motor 12, and transmit the monitor signal to the control circuit 202, which represents the abnormality of the first control signal. When the frequency of the first control signal is between the first threshold frequency $F_1$ and the third threshold frequency $F_3$, the driving circuit 210 stops to supply the current to the motor, and transmit the monitor signal to the control circuit 201, which represents the normality of the first control signal. Thus, when the frequency of the first control signal is lower than the first threshold frequency $F_1$, the control circuit 202 does not need to generate the control signal because the control circuit 202 determines the control circuit 210 is normal.

In the above embodiment, the first control signal has the frequency which is in proportion to the target number R. The other control signal can be used as the first control signal if the frequency of the signal increases according as the target number R increases.

In the above embodiments, when the frequency of the first control signal is the first threshold frequency $F_1$ or lower or when the frequency of the first control signal is the second threshold frequency $F_2$ or higher, the driving circuit 110 stops to supply the current to the motor 12. Alternatively, when the frequency of the first signal is the first threshold frequency $F_1$ or lower, the driving circuit 110 supplies the current to the motor 12. Even when the frequency of the first control signal is the second threshold frequency $F_2$ or higher, the driving circuit 110 can supply the current to the motor 12. Alternatively, when the frequency of the first control signal is the second threshold frequency $F_2$ or higher, the driving circuit 110 can stop to supply the current to the motor 12. When the frequency of the first control signal is the first threshold frequency $F_1$ or lower, the driving circuit 110 can supply the current to the motor 12.

The target number R can be a value which comprised of the absolute number of the target number and the code which represents the rotational direction of the motor 12.

In the second embodiment, the monitor section 240 generates the monitor signals which represents the abnormality of the first control signal, the abnormality of the Hall effect device 18, the current abnormality of the inverter circuit 252 and the motor 12, and the over-current abnormality of the inverter circuit 252 and the motor 12. The monitor section 240 can generate a monitor signal which represents of the above three abnormalities other than the abnormality of the first control signal without the third comparator 214. Alternatively, one or two signal lines of the signal lines 223, 224, 225 for the Hall effect device, the signal lines 226, 227, 228 for voltage monitor, and the signal lines 229 for current monitor can be omitted. The monitor section 240 can generate monitor signals which represents the abnormalities other than the abnormalities corresponding to the omitted signal lines. That is, the monitor section can generate the monitor signal which does not represent one or two of the abnormalities with respect to the Hall effect device 18, the current passing through the inverter circuit 252 and the motor 12, the over-current passing through the inverter circuit 252 and the motor 12.

What is claimed is:

1. A valve timing controller for adjusting valve timing of an engine utilizing rotational torque of a motor, the valve timing controller comprising:

a control circuit generating a control signal; and a driving circuit driving the motor based on a target rotation speed which is represented by the control signal frequency, the motor rotating at the same speed as an engine camshaft when rotational phase of the camshaft relative to an engine crankshaft is to be maintained, wherein a higher frequency of the control signal represents a higher target rotation speed, and the driving circuit stops supplying current to the motor when the frequency of the control signal is lower than or equal to a threshold frequency greater than zero.

2. A valve timing controller for adjusting valve timing of an engine utilizing rotational torque of a motor, the valve timing controller comprising:

a control circuit generating a control signal; and a driving circuit driving the motor based on a target rotation speed which is represented by the control signal frequency, the motor rotating at the same speed as an engine camshaft when rotational phase of the camshaft relative to an engine crankshaft is to be maintained, wherein a higher frequency of the control signal represents a higher target rotation speed, and the driving circuit stops supplying current to the motor when the frequency of the control signal is higher than or equal to a threshold frequency greater than zero.

3. A valve timing controller for adjusting valve timing of an engine utilizing rotational torque of a motor, the valve timing controller comprising:

a control circuit generating a control signal; and a driving circuit driving the motor based on a target rotation speed which is represented by the control signal frequency, the motor rotating at the same speed as an engine camshaft when rotational phase of the camshaft relative to an engine crankshaft is to be maintained, wherein a higher frequency of the control signal represents a higher target rotation speed, and the driving circuit stops supplying current to the motor when the frequency of the control signal is either lower than or equal to a first threshold frequency, or higher than or equal to a second threshold frequency, the first threshold frequency being greater than zero and also less than the second threshold frequency.

4. A valve timing controller as in claim 1, wherein the control signal frequency is in proportion to the target rotation speed.

5. A valve timing controller as in claim 2, wherein the control signal frequency is in proportion to the target rotation speed.

6. A valve timing controller as in claim 3, wherein the control signal frequency is in proportion to the target rotation speed.

7. A valve timing controller as in claim 1, wherein the driving circuit transmits a monitor signal to the control circuit, the monitor signal representing the present condition of drive signals being presented to the motor.

8. A valve timing controller as in claim 2, wherein the driving circuit transmits a monitor signal to the control circuit, the monitor signal representing the present condition of drive signals being presented to the motor.

9. A valve timing controller as in claim 3, wherein the driving circuit transmits a monitor signal to the control circuit, the monitor signal representing the present condition of drive signals being presented to the motor.

10. A valve timing controller as in claim 4, wherein the driving circuit transmits a monitor signal to the control circuit, the monitor signal representing the present condition of drive signals being presented to the motor.

11. A valve timing controller as in claim 1, wherein the control circuit controls an operation of the engine.

12. A valve timing controller as in claim 2, wherein the control circuit controls an operation of the engine.

13. A valve timing controller as in claim 3, wherein the control circuit controls an operation of the engine.

14. A valve timing controller as in claim 4, wherein the control circuit controls an operation of the engine.

15. A valve timing controller as in claim 5, wherein the control circuit controls an operation of the engine.

16. A method for adjusting valve timing of an engine having a crankshaft variably coupled via rotational torque of an electric motor to a camshaft, said method comprising:

generating a control signal used to drive said motor based on a target rotation speed which is represented by the control signal frequency, the motor rotating at the same speed as an engine camshaft when rotational phase of the camshaft relative to an engine crankshaft is to be maintained wherein a higher frequency of the control signal represents a higher target rotation speed, and stopping current to the motor when the frequency of the control signal is in at least one of the conditions: (a) lower than or equal to a threshold frequency greater than zero; and (b) higher than or equal to a second threshold frequency greater than said first threshold frequency.

* * * * *